US005524911A

United States Patent [19]

Cochimin

[11] Patent Number: 5,524,911

[45] Date of Patent: Jun. 11, 1996

[54] CONVERTIBLE IN-LINE/PARALLEL SKATES

[76] Inventor: Jimmy Cochimin, 4431 Fairfield Ave., Fort Wayne, Ind. 46807

[21] Appl. No.: 280,806

[22] Filed: Jul. 26, 1994

[51] Int. Cl.[6] ..... A63C 17/02

[52] U.S. Cl. ..... 280/7.1; 280/11.22; 280/11.27

[58] Field of Search ..... 280/7.1, 7.15, 280/841, 11.19, 11.22, 11.27, 7.12, 7.13, 11.23, 11.28

[56] References Cited

U.S. PATENT DOCUMENTS

| | | | |
|---|---|---|---|
| 177,566 | 5/1876 | Saladee . | |
| 1,309,493 | 7/1919 | Tyler . | |
| 1,527,840 | 2/1925 | Chomin . | |
| 2,035,897 | 3/1936 | Kosanovich | 208/173 |
| 2,512,524 | 6/1950 | Gallo, Jr. | 280/7.1 |
| 2,591,534 | 4/1952 | Gallo et al. | 280/7.15 |
| 3,086,787 | 4/1963 | Wyche | 280/11.19 |
| 3,901,520 | 8/1975 | McMahan | 280/7.13 |
| 4,492,385 | 1/1985 | Olson | 280/7.13 |
| 5,193,827 | 3/1993 | Olson | 280/7.13 |
| 5,295,701 | 3/1994 | Reiber et al. | 280/11.22 |
| 5,372,534 | 12/1994 | Levy et al. | 280/11.22 X |

*Primary Examiner*—Brian L. Johnson
*Assistant Examiner*—Michael Mar
*Attorney, Agent, or Firm*—Baker & Daniels

[57] ABSTRACT

The present invention involves a skate that can be converted from an in-line wheel configuration in which all of the skate wheels are coplanar to a parallel or quad wheel configuration, and vice versa. The skate includes a foot or shoe enclosure, a wheel chassis, a wheel support, at least two wheels, and a tie rod which anchors the wheel chassis at a center point and allows the wheel chassis to pivot the wheels from an in-line to a parallel configuration. The foot enclosure includes posts which support and secure the wheel chassis, with a nut threadably engaging the post to rotatably secure the wheel chassis relative to the foot enclosure. The tie rods have a predetermined length which maintains the angular position of the wheels relative to the foot enclosure regardless of the angular position of the wheel chassis.

27 Claims, 4 Drawing Sheets

CONVERTIBLE IN-LINE/PARALLEL SKATES

BACKGROUND OF THE INVENTION

1. Field of the Invention

The present invention relates to sporting goods, and particularly to skates. The field of the invention is that of skates having roller wheels.

2. Description of the Related Art

Skates having roller wheels are used for sporting, exercising, and recreational activities. Two varieties of roller skates are well known and used: in-line and parallel skates. These skate designs typically have four roller wheels, either all four in-line so that the planes of the wheels are all coplanar, or parallel in a two by two, or quad, arrangement. The skate also includes a foot or shoe enclosure with a base or chassis which rotatably supports the axles of the roller wheels. The in-line arrangement provides the wearer with the feel of an ice skate, while the parallel arrangement is more stable. Both arrangements are popular, with some activities being more suited for in-line skates, e.g., traveling over outdoor paths, playing field hockey, and other activities for quad or parallel skates, e.g., skating at roller domes, training skaters.

The foot or shoe enclosure portion of the skate is similar for both arrangements. However, the wheel support portions of the skates are typically made from a fixed frame that rotatably supports the axles of the roller wheels. The sharp contrast between the in-line and parallel arrangement requires that the wheel support portions of those skates be dramatically different. Also, the foot or shoe enclosure portion attaches to each type of wheel support arrangement differently. For example, with in-line skates, two elongated plates can serve as journals for all the roller wheel axles. However, it is impractical to provide parallel skates with common journals because of the increased width between the wheels of the parallel skates, although each pair of the parallel wheels may share a common axle. For a skater to utilize both arrangements, one pair of skates for each arrangement must be obtained.

One known convertible skate allows the substitution of a set of in-line roller wheels with a blade for ice skating. This structure actually requires that an assembly of roller wheels be removed and a separate blade assembly be attached to convert the skates. With this design, the same foot enclosure may be used with either arrangement. However, this design requires that the skater carry the spare parts that are removed and replaced. Further, while this design allows for the substitution of a support for in-line roller wheels and a support for an ice skating blade, it does not provide support for a parallel arrangement of roller wheels.

What is needed is a skate which may be readily converted from an in-line arrangement to a parallel arrangement.

SUMMARY OF THE INVENTION

The present invention provides a skate that can be converted from an in-line wheel configuration in which all of the skate wheels are coplanar to a parallel wheel configuration, and vice versa. In a simple operation, the wheel configuration may be manually converted using only repositioning of the equipment on the skate itself.

Both in-line and quad skates are used for sporting and recreational purposes. The traditional quad skate has enjoyed long-standing popularity, while wide-spread commercialization of the in-line skate is relatively recent. The quad skate is particularly suitable for use in places such as roller rinks, while the in-line skate tends to prevail in outdoor use. Generally, the places and uses of the two types of skates are characteristic to each skate. A skater's choice of an in-line or a quad skate then often depends on the type of activity in which the skater wishes to engage. Thus, a skating enthusiast would require more than one pair of skates to fulfill all skating activities in which he might wish to engage. The skater would thus incur the expense of buying more than one pair of skates, and the inconvenience of having to change skates depending on the activity in which the skater desires to engage at a given time.

The present invention utilizes a wheel chassis mounted on posts attached to the bottom of the foot or shoe enclosure. The wheel chassis supports the wheels and is rotatable about the post. Tie rods connect the post to the wheels which are supported by the wheel chassis. The wheel chassis is rotatable between at least two positions, and the connection of the wheels to the post through the tie rods ensures that the angular orientation of the wheels are maintained. The tie rods have a predetermined position relative to the post and the wheels so that the wheels are angularly positioned relative to the post. Thus, the tie rods keep the wheels always parallel to the length of the foot or shoe enclosure at the predetermined positions. By rotating the wheel chassis, the wheels may be positioned either in an in-line arrangement, wherein the planes of the wheels are coextensive, and a parallel arrangement, wherein the wheels are parallel and coaxial.

By mounting the wheel chassis on the post, many different varieties of foot or shoe enclosures may be utilized with the invention. The posts, in conjunction with the wheel chassis, provide support for the foot or shoe enclosure portion to enhance the rigidity of the foot enclosure and enhance its structural integrity. In one embodiment, two posts are utilized with corresponding wheel chassis and each wheel chassis supports two wheels. This allows for four in-line roller wheels to be employed, which may be readily changed to a two by two parallel arrangement. The change is effected by loosening a nut which engages the wheel chassis, turning the chassis, and tightening the nut.

The invention comprises, in one form thereof, a skate with an enclosure, at least one wheel chassis, at least one wheel support, and at least two wheels. The enclosure has at least one rotatably attached wheel chassis. The wheel chassis supports at least two rotatably connected wheels. By positioning the wheel chassis, the wheels can be arranged in one of at least two configurations of the wheels: an in-line wheel configuration and a parallel wheel configuration.

An advantage of the present invention is that a single skate can assume the configuration of either an in-line or a quad skate.

Another advantage is that the present invention can easily and quickly be converted from an in-line to a quad skate and vice versa.

Another advantage is that the present invention can be converted from an in-line to a quad skate and vice versa without removing or adding any equipment.

A further advantage is that the present invention can be used in a variety of locations and under a variety of different conditions calling for skates of different wheel configurations without need for investment in different skates.

A further advantage is that the same wheel and support system of the present invention can be used regardless of the style of the foot or shoe enclosure.

Yet another advantage of the present invention is that the enclosure material surrounding the post is strengthened and the enclosure material thus rigidly supports the wheels and enhances the longevity of the skate.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
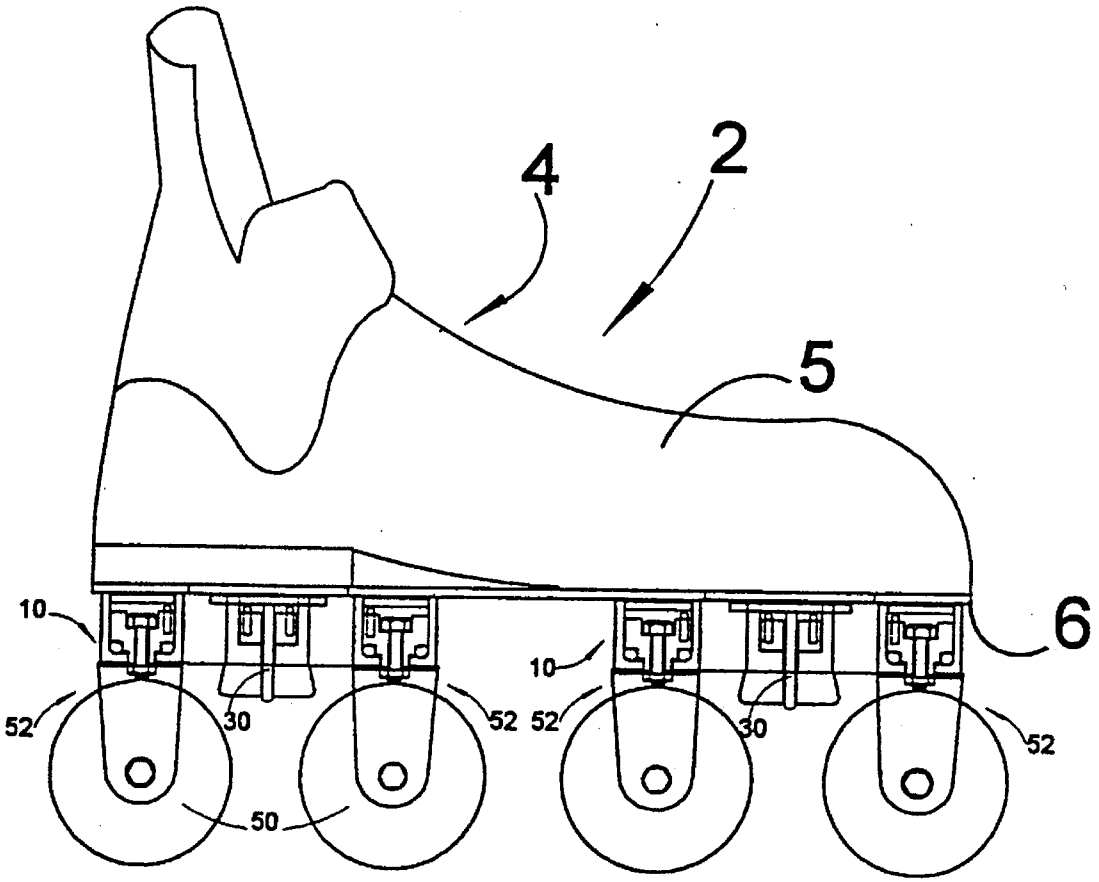
FIG. 1 is a side view of an in-line wheel configuration of an embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates one preferred embodiment of the invention, in one form, and such exemplification is not to be construed as limiting the scope of the invention in any manner.

DESCRIPTION OF THE PREFERRED EMBODIMENT

The preferred embodiment disclosed below is not intended to be exhaustive or limit the invention to the precise form disclosed in the following detailed description. Rather, the embodiment is chosen and described so that others skilled in the art may utilize its teachings.

In accordance with the present invention, skate 2 includes foot enclosure 4, wheel chassis 10, wheel supports 52, and roller wheels 50. Foot enclosure 4 (FIGS. 1 and 2) includes shoe 5 rigidly attached to shoe base 6. Although a foot enclosure is shown, one of ordinary skill would appreciate that a shoe enclosure could also be used with the present invention. On the underside of the enclosure portion of skate 2, wheel supports 52 may be arranged with wheels 50 in either the in-line arrangement of FIG. 1 or the parallel, quad arrangement of FIG. 2. Skate 2 may be readily converted between these arrangements by simple repositioning of the equipment below shoe base 6.

Wheel chassis 10 is rotationally disposed about center post 30 which has threaded portion 32. Center post 30 is rigidly attached to base 34. Center post 30 extends through hole 13 of enclosure or shoe support 11. Shoe support 11 is sandwiched between wheel chassis 10 and shoe base 6 and is rigidly attached to shoe base 6 by attaching wheel chassis 10 to shoe base 6 and post 30. The bottom face of shoe support 11 may have undercut slots that receive and constrain tie rods 18 in a tightened position in either of the in-line or parallel arrangements. Alternatively, the same purpose may be achieved without slots by the bottom face of shoe support 11 being comprised of a resilient material which constrains tie rods 18. Nut 36 is adjustably threaded onto threaded portion 32 to hold wheel chassis 10 against base 34.

Wheel chassis 10 also includes inserts 12 rotatably disposed in an opening of chassis 10. Inserts 12 function as a collar and allow wheel support 52 to rotate relative to wheel chassis 10. Preferably, inserts 12 have a major diameter in the range of 7.5 mm to 44.5 mm. 0-rings 19 may be optionally disposed between inserts 12 and chassis 10 to provide resilient dampening to the micro-movement of insert 12. Rod 20 is rigidly attached to insert 12, and to wheels 50 as described below. Inserts 12 include holes 14 which removably receive tie rods 18 which rotatably position inserts 12 relative to chassis 10. Holes 14 are located at a predetermined diameter, preferably about 2–5 mm away from the major diameter, outer perimeter, of insert 12, so that the relative rotation of inserts 12 and wheel chassis 10 is maintained such that whenever wheel chassis 10 is rotated by 90°, wheels 50 automatically follow the rotation to keep parallel to the length of enclosure 4.

Tie rods 18 functionally connect post 30 and wheel supports 52, and are of precision length to conform to predetermined engineered positions of the skate and wheel chassis. The connection of tie rods 18 with post 30 and wheel supports 52 provides for the automatic positioning of wheels 50. The preferred length of tie rod 18 equals the length of the distance between the axial center of post 30 and the axial center of insert 12, plus the diameter of tie rod 18. The center of holes 14 are preferably disposed at a 45° angle from the axial center of its insert 12 relative to a reference line extending through the center of both inserts 12 when they are disposed in wheel chassis 10. Also, holes 15 in collar 70, as described in greater detail below, are located at a predetermined diameter from the axial center of collar 70, preferably about 2–5mm away from the major diameter of collar 70, and are also disposed at a 45° angle from the axial center of collar 70 relative to the same reference line.

Wheel supports 52 include crosspieces 56 rigidly attached to rod 20 by nut 22. Alternatively, rod 20 may be connected to wheel supports 52 by a rivet or other suitable attachment. Arms 54 are rigidly attached to crosspiece 56 to form a U shaped supporting piece. Axle 58 is journalled between arms 54. Wheel 50 rotates about axle 58 and is secured to axle 58 by nut 60. Alternatively, wheel 50 may be connected to axle 58 by a rivet or other suitable attachment. With rod 20 rigidly attached to both insert 12 and wheel support 52, the pivotal movement of insert 12 within wheel chassis 10 causes the angular position of wheel 50 to change relative to wheel chassis 10. However, the structure and arrangement of tie rods 18 ensure that the angular position of wheel 50 relative to enclosure 4 remains substantially constant.

Figure 5:
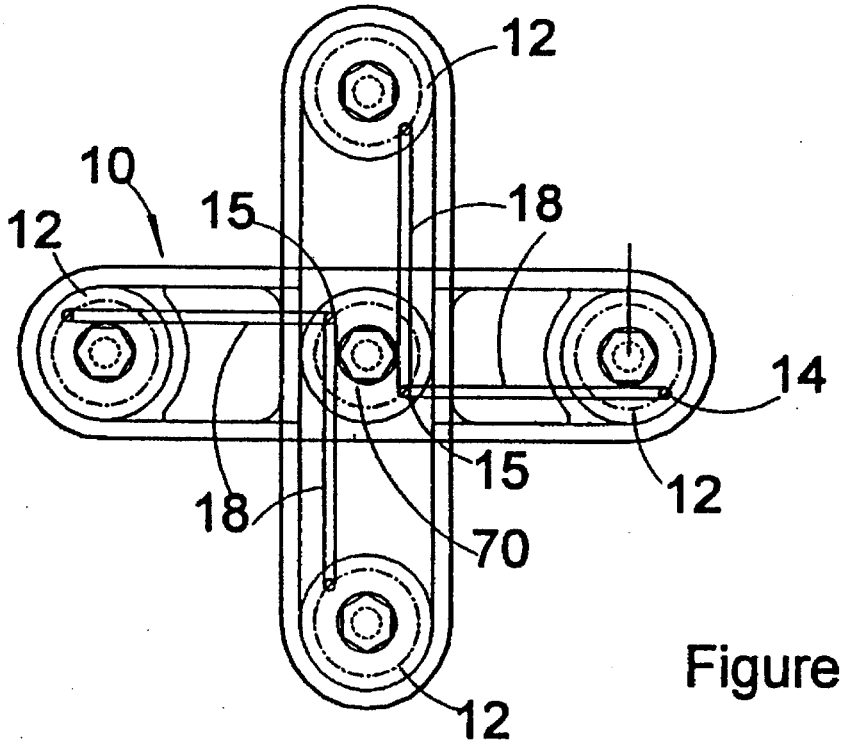
FIG. 5 is a top view of two rotational configurations of the wheel assemblies shown in FIGS. 3 and 4.
Figure 6:
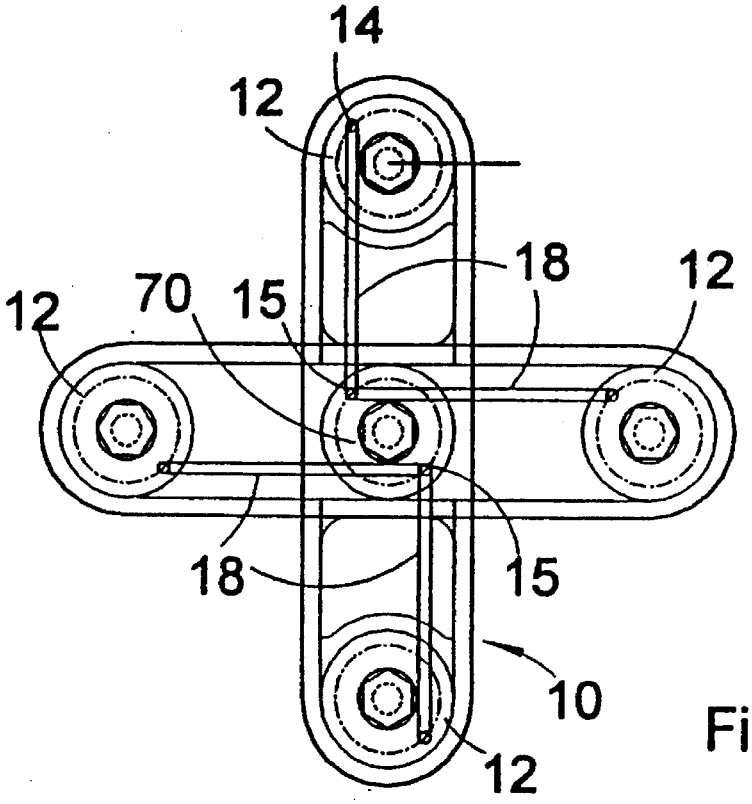
FIG. 6 is another top view of two other rotational configurations of the wheel assemblies shown in FIGS. 3 and 4.
Figure 7:
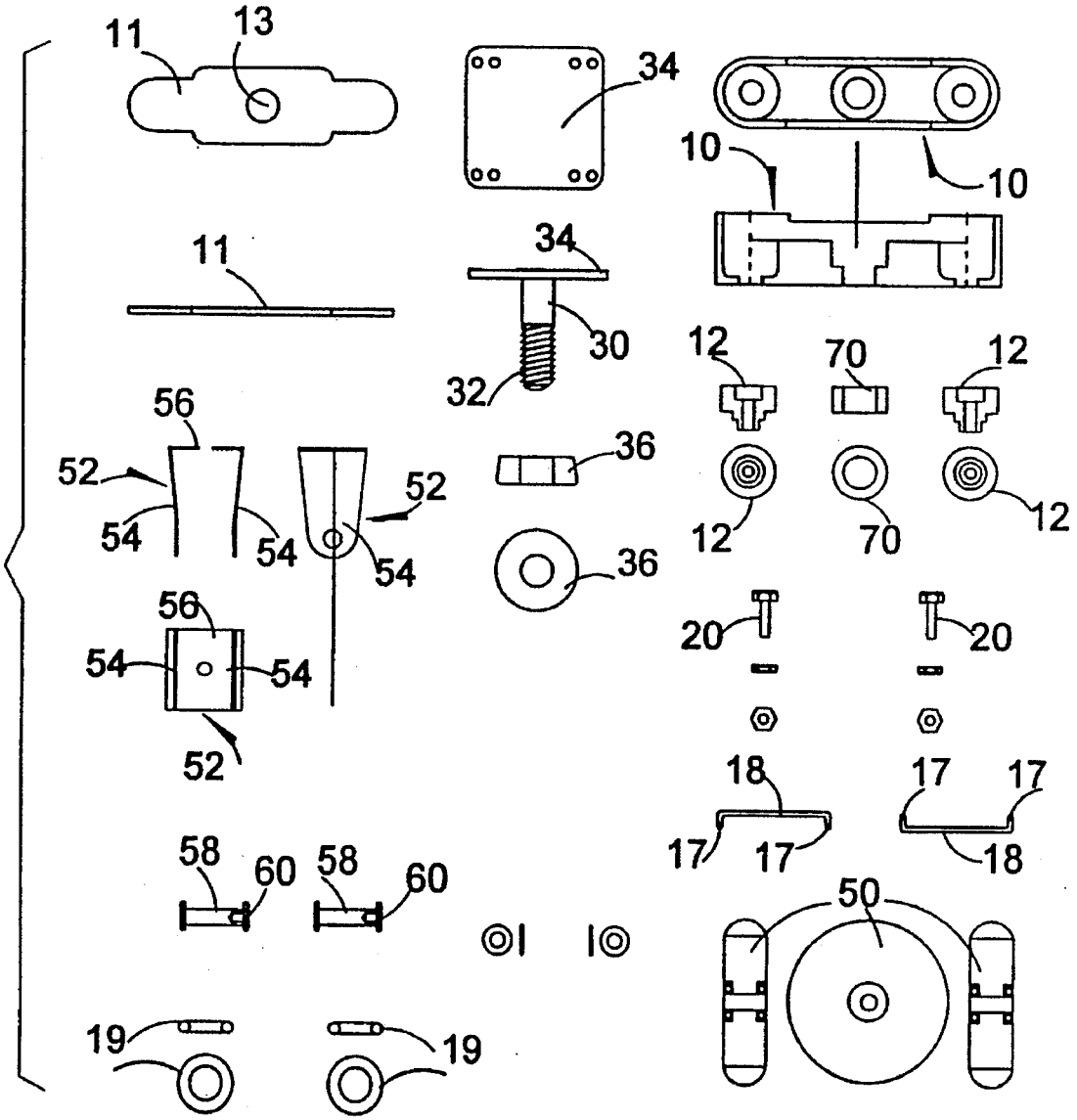
FIG. 7 is an exploded view of various component parts of the embodiment shown in the preceding Figures.

To arrange skate 2 in a particular wheel configuration, nut 36 is loosened and wheel chassis 10 is rotated about post 32 to the desired position. The rotation of the wheel support 52 and wheel chassis 10 together causes the skate to assume the configuration of either a quad or in-line skate. As shown in FIGS. 5 and 6, finger 17 at one end of tie rod 18 is pivotally inserted into holes 15 of collar 70, and collar 70 is fixed to center post 30. Finger 17 at the other end of tie rod 18 is pivotally inserted into hole 14 of insert 12. Tie rod 18 is prevented from escaping this position because of the small clearance available when nut 36 attaches chassis 10 to base 34, and because of the constraint by shoe support 11 when nut 36 is tightened. As shown in FIGS. 5 and 6, rotation of wheel chassis 10 pivots tie rod 18 about collar 70, changing the configuration of wheels 50 from an in-line to a parallel or quad position and vice versa.

To obtain the in-line skate wheel configuration shown in FIG. 1, nut 36 is loosened, and wheel chassis 10 is rotated to a position parallel to the shoe base 6. As wheel chassis 10 is rotated, tie rod 18 pivots about collar 70, contemporaneously pivoting wheels 50 to a position parallel to shoe base 6. Nut 36 is then tightened on threaded post 32 to maintain wheel chassis 10 in a position parallel to shoe base 6. Optionally, wheel chassis 10 may include a notch or other structure to engage base 34 in this position when nut 36 is sufficiently tightened.

Figure 2:
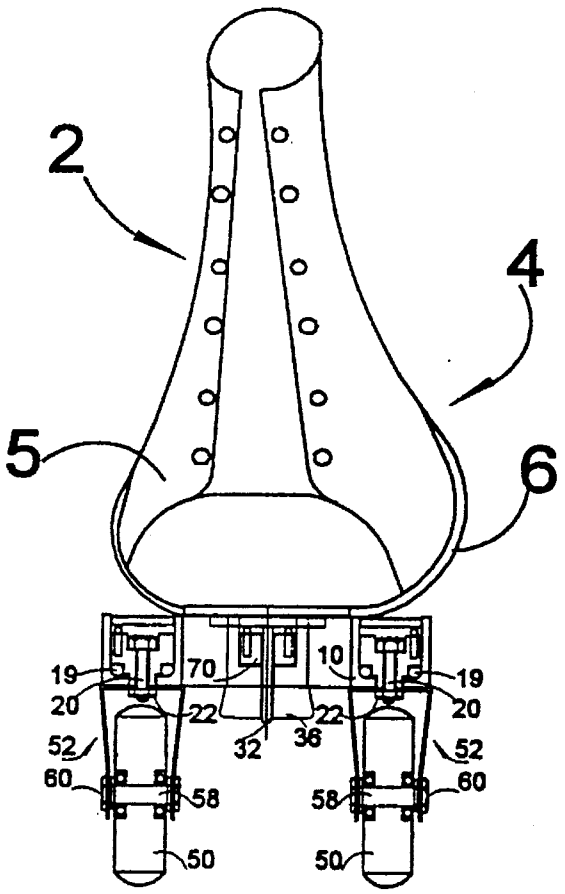
FIG. 2 is a front view, showing both pairs of wheels, of a parallel wheel configuration of an embodiment of the present invention.
Figure 4:
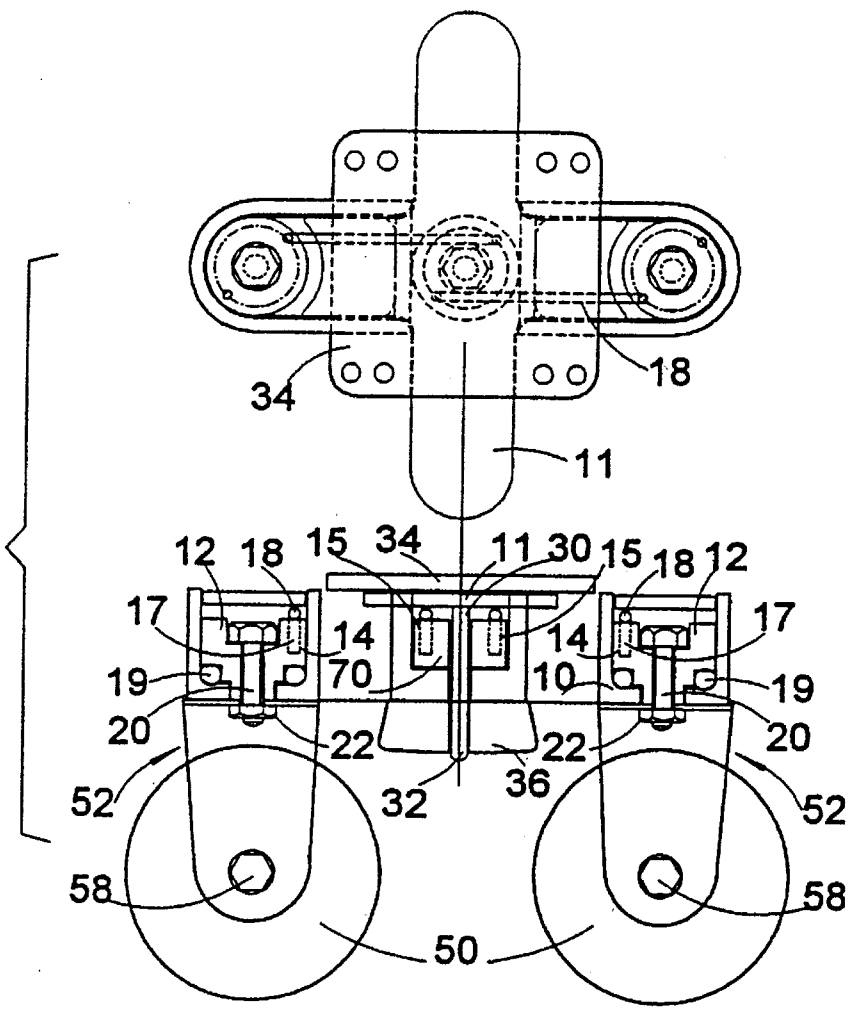
FIG. 4 is a side view of the wheel assembly of FIG. 1.
Figure 3:
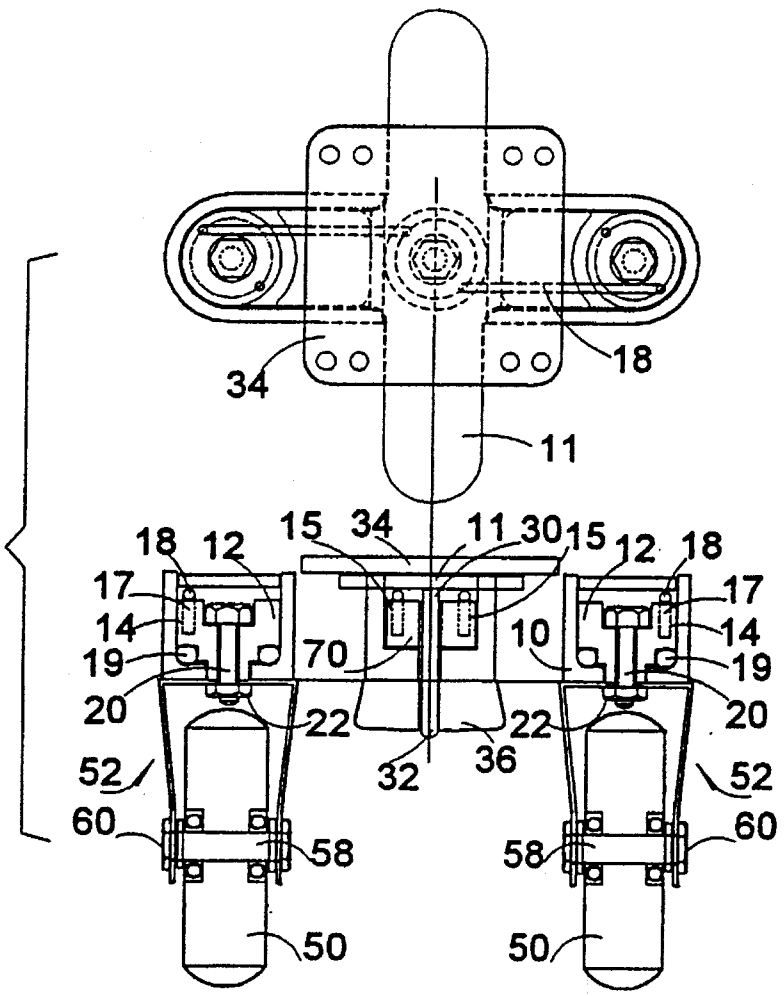
FIG. 3 is a front view of the wheel assembly of FIG. 2.

To obtain the quad skate wheel configuration shown in FIG. 2, nut 36 is loosened, and wheel chassis 10 is rotated to a position perpendicular to shoe base 6. As wheel chassis 10 is rotated, tie rod 16 pivots about collar 70, contemporaneously pivoting wheels 50 to a position parallel to shoe base 6. Nut 36 is then tightened on threaded post 32 to maintain wheel chassis 10 in a position perpendicular to shoe base 6. Optionally, wheel chassis 10 may include a notch or other structure to engage base 34 in this position when nut 36 is sufficiently tightened.

The embodiment of the present invention shown in the drawings includes four wheels; FIG. 1 shows the four wheels in one line, while FIG. 2 shows the wheels at the four corners of a square or rectangle. Alternatively, a skate defined by the present invention could have virtually any configuration of skate wheels, for example combinations of 2×1 parallel and 1×2 in-line, or 2×3 parallel and 1×6 in-line, or even combinations of odd numbers of wheels for each foot, such as 1 +2×1 parallel and 1×3 in-line wheel configurations.

The embodiment of the present invention shown in FIGS. 1 and 2 show an enclosure with closed geometry, such as a shoe, with fixed dimensions. In fact, the enclosure of the skate may have either closed geometry as in a shoe, the enclosure may have open geometry as in a sandal, or the enclosure may be structured and arranged to attach to a shoe or boot. In addition, the enclosure may have either fixed or adjustable dimensions.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A convertible skate comprising:

an enclosure;

a base frame attached to said enclosure;

at least one vertical post attached to said base frame;

at least one wheel chassis, each said wheel chassis including a chassis body pivotably attached to said vertical post, a pair of wheels, a pair of wheel supports for rotatably supporting said wheels in a vertical rotational plane relative to a ground surface, each said wheel support being pivotably connected to a respective end of said wheel chassis for movement about a vertical axis, said wheel chassis further including means for connecting said wheel supports to a fixed member located proximate said vertical post, said connecting means changing the pivotal position of the vertical axes of said wheel supports in response to pivotal movement of said wheel chassis relative to said vertical post, whereby the vertical rotational planes of said pair of wheels may be selectively arranged either in-line along a longitudinal axis of the skate or transversely along each side of the longitudinal axis in response to a selected pivotal position of said wheel chassis.

2. The skate of claim 1 further comprising locking means attached to said vertical post for selectively locking said chassis in a pivotal angle.

3. The skate of claim 2 wherein said locking means includes a threaded portion of said post and a nut threadably engaging said threaded portion to rotationally secure the position of said wheel chassis.

4. The skate of claim 1 wherein said connecting means includes two tie rods, each said tie rod connecting a respective one of said pair of wheels.

5. The skate of claim 4 further comprising a collar fixed to said vertical post and engaging said tie rods, and each said tie rod is pivotally connected to a respective one of said pair of wheels.

6. The skate of claim 5 further including two inserts rotatably disposed in said wheel chassis and fixed to a respective one of said pair of wheels each, said tie rod being pivotally connected to a respective one of said inserts.

7. The skate of claim 4 wherein said tie rods have a predetermined length which maintains the angular position of said pair of wheels relative to said enclosure regardless of the angular position of said wheel chassis.

8. The skate of claim 7, further including two inserts rotatably disposed in said wheel chassis and fixed to a respective one of said pair of wheels each, said tie rod being pivotally connected to a respective one of said inserts, wherein said predetermined length substantially equals the distance between the center of said vertical post and the center of said insert, and the ends of each said tie rod are so connected such that the line connecting one end of said tie rod to the center of said post and the line connecting the other end of said tie rod to the center of said insert are both at a 45° angle relative to the center line defined by the centers of said inserts.

9. The skate of claim 1 wherein each of said pair of wheels includes a U shaped crosspiece journalling an axle which rotatably supports a roller wheel.

10. The skate of claim 1 wherein said vertical post includes a base rigidly attached to said enclosure.

11. A skate comprising:

an enclosure having a rigidly attached post;

at least two wheels, each said wheel attached to an associated rotational support collar for rotational movement in a vertical plane;

a wheel chassis rotatably disposed on said post and rotatably receiving each said rotational support collar, each wheel support collar being pivotably connected to a respective end of said wheel chassis for movement about a vertical axis; and a connector connecting a fixed member located proximate said post to each of said rotational support collars, said connector changing the pivotal position of the vertical axes of said rotational support collar in response to pivotal movement of said wheel chassis relative to said post, whereby the vertical rotational planes of said at least two wheels may be selectively arranged either in-line along a longitudinal axis of the skate or transversely along each side of the longitudinal axis in response to a selected pivotal position of said wheel chassis.

12. The skate of claim 11 wherein said connector includes at least two tie rods, each said tie rod associated with one of said rotational support collars, each tie rod having a predetermined fixed length so that rotation of said wheel chassis relative to said post causes the rotation of said rotational support collars and thereby maintains the angular position of said wheels relative to said post.

13. The skate of claim 12 wherein said predetermined length substantially equals the distance between the center of said post and the center of said rotational support collar, and the ends of each said tie rod are so connected such that the line connecting one end of said tie rod to the center of said post and the line connecting the other end of said tie rod to the center of said rotational support collar are both at a 45° angle relative to the center line defined by the centers of said rotational support collars.

14. The skate of claim 11 wherein said post includes a threaded portion, and said skate further comprising a nut threadably engaging said threaded portion to rotationally secure the position of said wheel chassis.

15. The skate of claim 11 wherein said rotational support collars have a major diameter in the range of 7.5 mm to 44.5 mm.

16. The skate of claim 12 wherein said tie rods are pivotally connected to said rotational support collars.

17. The skate of claim 11 wherein each of said at least two wheels includes a U shaped crosspiece journalling an axle which rotatably supports a roller wheel.

18. The skate of claim 11 wherein said post includes a base rigidly attached to said enclosure.

19. The skate of claim 11 further comprising an enclosure support sandwiched between the bottom surface of said enclosure and said wheel chassis to enhance the rigidity of support from the wheels.

20. A combination wheel support and chassis for use in a roller skate, said combination comprising:

a pair of wheels;

a pair of wheel supports for rotatably supporting said wheels in a vertical rotational plane relative to a ground surface;

a chassis body having means for pivotably attaching to a vertical post of the roller skate, each said wheel support being pivotably disposed in a respective end of said chassis for movement about a vertical axis, said wheel chassis further including means for connecting said wheel supports to the vertical post, said connecting means changing the pivotal position of the vertical axes of said wheel supports in response to pivotal movement of said wheel chassis relative to the vertical post, whereby the vertical rotational planes of said pair of wheels may be selectively arranged either in-line along a longitudinal axis of the skate or transversely along each side of the longitudinal axis in response to a selected pivotal position of said wheel chassis.

21. The combination of claim 20 further comprising a collar adapted to be attached to a base associated with the vertical post, said wheel chassis having a central bore shaped to receive said collar.

22. The combination of claim 21 wherein said connecting means includes a pair of tie rods, wherein said tie rods pivotally engage said collar and a respective one of said wheel supports.

23. The combination of claim 22 wherein said tie rods have a predetermined length which maintains the angular position of said pair of wheels relative to said longitudinal axis of the skate regardless of the angular position of said wheel chassis relative to said longitudinal axis of the skate.

24. A combination wheel support and chassis for use in a roller skate, said combination comprising:

at least two wheels;

at least two rotational support collars, each said wheel attached for movement in a vertical rotational plane to an associated one of said rotational support collars;

a wheel chassis rotatably disposed on a vertical post of the roller skate, each said wheel support collar being pivotably connected to a respective end of said wheel chassis for movement about a vertical axis; and a connector connecting said vertical post of said roller skate to each of said rotational support collars and changing the pivotal position of the vertical axes of said wheel support collars in response to pivotal movement of said wheel chassis relative to the vertical post, whereby the vertical rotational planes of said at least two wheels may be selectively arranged either in-line along a longitudinal axis of the skate or transversely along each side of the longitudinal axis in response to a selected pivotal position of said wheel chassis.

25. The combination of claim 24 further comprising a collar adapted to be attached to a base associated with the vertical post, said wheel chassis having a central bore shaped to receive said collar.

26. The combination of claim 25 wherein said connector comprises a pair of tie rods, each said tie rod pivotally engaging said collar and a respective one of said wheel supports.

27. The combination of claim 26 wherein said tie rods have a predetermined length which maintains the angular position of said pair of wheels relative to said longitudinal axis of the skate regardless of the angular position of said wheel chassis relative to said longitudinal axis of the skate.

* * * * *

UNITED STATES PATENT AND TRADEMARK OFFICE

CERTIFICATE OF CORRECTION

PATENT NO. : 5,524,911

DATED : June 11, 1996

INVENTOR(S) : Jimmy Cochimin

It is certified that error appears in the above-indentified patent and that said Letters Patent is hereby corrected as shown below:

Col. 5, Claim 1, line 59, delete "a".
Claim 1, line 60, change "plane" to --planes--.
Col. 6, Claim 11, line 46, after "attached" insert --for rotational movement in a vertical plane--.
Claim 11, line 47, delete "for rotational movement in a vertical plane".
Col.7, Claim 20, line 37, delete "a".
Claim 20, line 37, change "plane" to --planes--.

Signed and Sealed this

Fourth Day of March, 1997

*Attest:*

*Attesting Officer*

BRUCE LEHMAN

*Commissioner of Patents and Trademarks*